US007837759B2

(12) United States Patent
Wellwood et al.

(10) Patent No.: US 7,837,759 B2
(45) Date of Patent: Nov. 23, 2010

(54) LOW TEMPERATURE INDUSTRIAL PROCESS

(75) Inventors: Grant Ashley Wellwood, Victoria (AU); Christian Doblin, Victoria (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 409 days.

(21) Appl. No.: 11/665,982

(22) PCT Filed: Oct. 14, 2005

(86) PCT No.: PCT/AU2005/001554

§ 371 (c)(1),
(2), (4) Date: Jun. 30, 2008

(87) PCT Pub. No.: WO2006/042360

PCT Pub. Date: Apr. 27, 2006

(65) Prior Publication Data

US 2008/0307925 A1 Dec. 18, 2008

(30) Foreign Application Priority Data

Oct. 20, 2004 (AU) ..... 2004906084

(51) Int. Cl.
*B22F 9/28* (2006.01)

(52) U.S. Cl. ..... 75/366; 75/619

(58) Field of Classification Search ..... 75/366, 75/619

See application file for complete search history.

(56) References Cited

U.S. PATENT DOCUMENTS

| | | | | |
|---|---|---|---|---|
| 4,310,495 | A * | 1/1982 | Bonsack | 423/76 |
| 5,032,176 | A * | 7/1991 | Kametani et al. | 75/416 |
| 6,824,585 | B2 * | 11/2004 | Joseph et al. | 75/10.19 |
| 6,955,703 | B2 * | 10/2005 | Zhou et al. | 75/351 |
| 2002/0005090 | A1 * | 1/2002 | Armstrong et al. | 75/617 |

FOREIGN PATENT DOCUMENTS

| | | | |
|---|---|---|---|
| GB | 2231883 | A * | 11/1990 |
| WO | WO-2005/028145 | A2 * | 3/2005 |

* cited by examiner

*Primary Examiner*—George Wyszomierski
(74) *Attorney, Agent, or Firm*—Sughrue Mion, PLLC

(57) ABSTRACT

This invention relates to a method for producing titanium by reaction of titanium tetrachloride with magnesium in a reactor, wherein the temperature in the reactor is above the melting point of magnesium and below the melting point of magnesium chloride, wherein the reaction results in formation of particles comprising titanium, and wherein the particles are removed from the reactor and processed in order to recover the titanium.

12 Claims, 1 Drawing Sheet

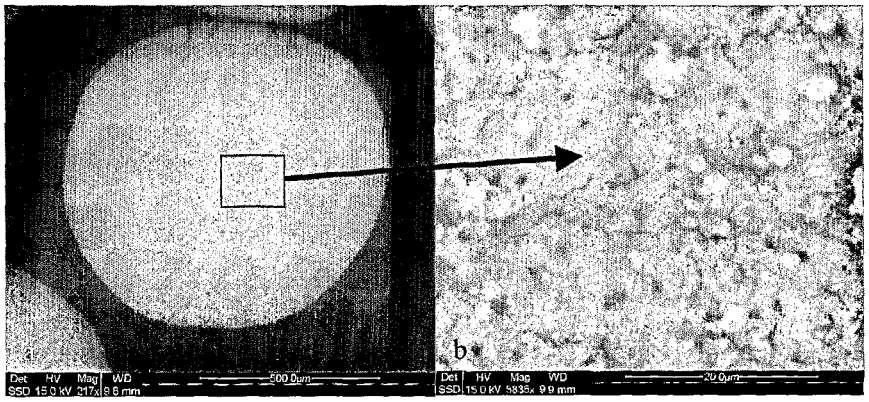
Figure 1a/b: ESEM Images of Low Temperature reaction product
a) Image of a single particle, b) showing discrete titanium particles (light specs) imbedded in a continuous $MgCl_2$ phase (dark phase).
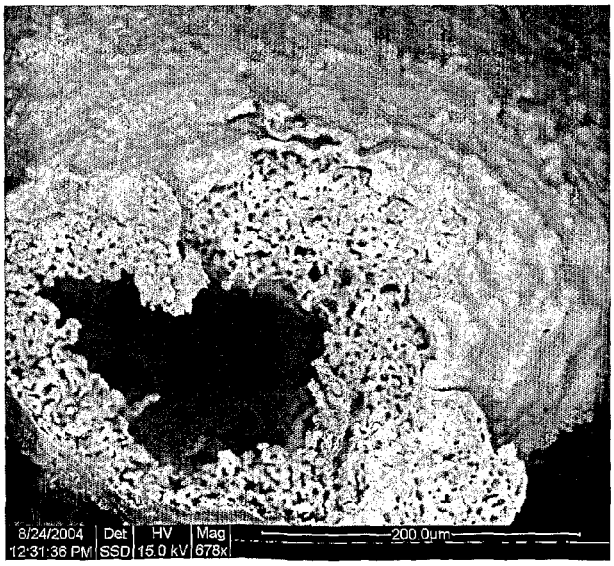
Figure 2: ESEM Image of hollow titanium sphere from heat treatment of $MgCl_2$/Ti composite particle.

LOW TEMPERATURE INDUSTRIAL PROCESS

The present invention relates to the production of titanium metal from titanium tetrachloride by reduction using magnesium (i.e. by magnesiothermic reduction).

The Kroll process (U.S. Pat. No. 2,205,854) is used the world over for production of titanium by magnesium reduction of titanium chloride. The reaction is carried out in a steel reactor where molten magnesium and gaseous titanium chloride are contacted, the titanium being produced in the form of a "sponge". Although the process has been employed for about 50 years, there is no clear understanding of the reaction mechanism involved and of sponge formation. The reaction is believed to be represented by the following equation:

$$TiCl_{4(g)}+2Mg_{(l)}=Ti_{(s)}+2MgCl_{2(l)}$$

Thus, under the prevailing conditions in the reactor, the magnesium chloride by-product is produced as a liquid and this enables it to be removed periodically from the reactor.

Unfortunately, the Kroll process is a batch process with low intensity and low titanium yield due to contamination of the sponge by iron from the reactor to which the sponge adheres as it is formed. Moreover, the magnesium chloride product and any unreacted magnesium tend to remain in the interstices created in the titanium sponge and these have to be removed subsequently by a vacuum distillation step. This is also a batch operation. In view of the contamination, the sponge has to be refined through one or more stages of vacuum are melting to produce titanium of acceptable quality. Even additional processing steps are required if the titanium is required in a powder form.

Furthermore, the process is not particularly environmentally friendly (due to waste streams and loss of batch containment), and there may also be occupational health and safety issues since the process tends to require significant manual intervention during operation.

Driven by these drawbacks, efforts have been made to develop alternative processes for the continuous production of titanium. A variety of different chemical pathways have been pursued and these can broadly be classified as either "wet" or "dry" according to the physical state of the magnesium chloride by-product that is produced.

With regard to the "wet" process, some research has focussed on continuous versions of the Kroll process where titanium tetrachloride is injected into molten magnesium to produce fine titanium particles. One such approach is described by Deura et al. (1998 Met. and Matrls. Trans. 29B p 1167-1173). This involves producing titanium particles by injecting gaseous titanium tetrachloride into a molten bath of magnesium chloride that is covered with a layer of molten magnesium metal. As titanium tetrachloride bubbles through the magnesium chloride layer it reacts with the magnesium at the interface between the two liquid layers. Results from a laboratory scale system have been reported. However, the process does not appear to be practiced commercially. This is probably due to operational problems associated with the process.

Another "wet" approach involves spraying molten magnesium droplets into a chamber containing titanium tetrachloride vapour (see Kametani et al. U.S. Pat. No. 5,032,176, for example). In this process the chamber is maintained at around 800° C. with a reservoir of molten magnesium chloride provided at its base as a sump. The products of the reaction (titanium particles and molten magnesium chloride) fall into the molten magnesium chloride sump. Two streams are withdrawn continually from the sump, one a magnesium chloride rich (upper) stream and the other a titanium-rich (magnesium chloride containing). The latter is formed as a result of settling of the higher density titanium particles. In common with other approaches mentioned above, the magnesium chloride phase is removed from the reaction stage as a liquid.

In "dry" processes deliberate steps are taken to maintain the by-product magnesium chloride in a gaseous form. Thus, in their patent U.S. Pat. No. 4,877,445, Okudaira et al. teach producing titanium powder in a single stage by contacting magnesium vapour and titanium tetrachloride vapour within a fluidised bed. The bed (fluidised with argon) is operated at high temperature (>1,100° C.) and at low absolute pressure (50 Torr) such that the only condensed species that may be present as a result of the reaction is titanium metal. The by-product magnesium chloride phase exists as a vapour under the prevailing conditions and is carried away from the bed with inert gas used to fluidise the bed. While the fluidised bed is conducive to hosting the process on a continuous basis, the elevated temperatures tend to cause finely divided titanium powder formed in the reactor to sinter, thereby locking the bed. There are also practical problems associated with continuous operation of the reactor at such low pressures. As a result of these issues commercial implementation of the process is untenable.

The proposals described above have in common that formation of titanium and separation of the by-product magnesium chloride from the titanium takes place in a single stage. To this end it is critical that the titanium and magnesium chloride are formed as different phases. However, regardless of whether the magnesium chloride is separated as a liquid or as a gas, conditions in the single stage operation are to a significant extent driven by the separation pathway being pursued. This can result in a compromise in terms of titanium productivity.

BRIEF DESCRIPTION OF DRAWINGS

FIGS. 1*a* and 1*b* illustrate ESEM images of low temperature reaction products. FIG. 1*a* shows an image of a single particle. FIG. 1*b* shows discreet titanium particles (light specks) embedded in a continuous $MgCl_2$ phase (dark phase).

FIG. 2 shows an ESEM image of hollow titanium sphere from heat treatment of $MgCl_2$/Ti composite particle.

Against this background the present invention seeks to provide an alternative process for producing titanium that does not suffer the disadvantages associated with the prior methods described.

Accordingly, the present invention provides a method for producing titanium by reaction of titanium tetrachloride with magnesium in a reactor comprising a fluidised bed, wherein the temperature in the reactor is above the melting point of magnesium and below the melting point of magnesium chloride, wherein the reaction results in formation of particles comprising titanium, and wherein the particles are removed from the reactor and processed in order to recover the titanium.

It will be appreciated from the foregoing that the process of the present invention involves two distinct stages. In the first stage particles comprising titanium are formed by reaction of magnesium and titanium tetrachloride. Invariably, the particles formed are actually composite particles comprising titanium and magnesium chloride, and the invention will be described in more detail with reference to these composite particles. Subsequently, and in a separate stage, the particles are processed in order to recover the titanium component. This processing takes place after the particles have been removed from the reactor. In producing titanium by a two stage process, the present invention represents a fundamental departure from the techniques acknowledged that aim to form titanium and separate it from the magnesium chloride by-product in a single stage.

Central to the present invention is the temperature in the reactor during operation of the process. Thus, it is a requirement of the invention that the temperature in the reactor be above the melting point of magnesium but below the melting point of magnesium chloride. In accordance with the present invention it has been found that conversion of titanium tetrachloride to titanium at such low operating temperatures is capable of producing titanium in unexpectedly high yield and at a suitably high rate. Conventional thinking may have predicted that this would not be possible.

In the context of the present invention reference to the temperature of the fluidised bed means the average or bulk temperature of the bed. There may be localised "hot spots" within the bed due to localisation of the exothermic reaction between magnesium and titanium tetrachloride. However, for the purposes of the present invention, the temperature observed at such "hot spots" should not be taken as being representative of the bed temperature.

Disregarding localised "hot spots" within the fluidised bed, the operating requirement of the process of the invention with respect to temperature means that in the fluidised bed the magnesium reactant will be present as a molten liquid and that the magnesium chloride produced as by-product will be present as a solid. Given this requirement, the temperature of the fluidised bed will be from 650° C. to less than 712° C. Usually, the bed temperature is from 650° C. to 710° C. Selection of an operating temperature will be based on a variety of other factors, as will be explained in more detail below.

In an embodiment of the invention it is possible to introduce into the reactor elements that it is desired to alloy with the titanium being produced. In this case the temperature in the reactor must also be suitably high to render the alloying element(s) liquid. Obviously, the alloying element is selected such that magnesium will preferentially react with the titanium tetrachloride, thereby avoiding any chemical reaction involving the alloying element. The alloying elements are usually metals, such as aluminium. It is a requirement however that the temperature in the fluidised bed will remain below the melting point of magnesium chloride.

It is also possible to introduce alloying elements as halides for reduction by reaction with magnesium. In this case the alloy halides are vaporised and introduced into the reactor in combination with the titanium tetrachloride. This technique may be used to introduce aluminium and vanadium, for instance.

For convenience the invention will be described with reference to the production of titanium, i.e. without alloying elements.

It perhaps goes without saying that at the operating temperature required titanium will be produced as a solid. It is possible for titanium particles to sinter at temperatures well below the melting point of titanium (1670° C.), especially where the particles are very fine. However, at the operating temperatures employed in the process of the present invention sintering is not likely to occur, even if fine particulate titanium is present in the fluidised bed.

The temperature of the fluidised bed may be determined by averaging the temperature observed at a number of locations within the bed. In this case it is desirable to measure the bed temperature at numerous locations in order to minimise the influence of "hot spots" on temperature measurement. As a preferred alternative the exit temperature of inert gas used to fluidise the bed may be taken as representative of the bed temperature. Irrespective of the method used, temperature measurement will typically involve conventional equipment such as thermocouples.

At the intended operating temperature of the process of the invention and under the prevailing conditions in the fluidised bed (including the degree of agitation of the particles making up the bed), it is important that the seed particles making up the bed do not sinter. This will have implications on selection of the seed particles for use in the process of the present invention, especially on start up. In principle the seed particles may be made of any material that is capable of acting as a reaction site for the reaction between molten magnesium and titanium tetrachloride vapour. Typically, however, the seed particles will be formed of titanium or of magnesium chloride. A mixture of the two may be used. The initial particle size of the seed particles will vary depending upon the scale of operation and the desired particle size of the product particles. Broadly speaking the initial particle size is from 10 μm to 2 mm, more likely from 250 to 500 μm.

On start-up of the process of the invention the seed particles are charged into a suitable reactor and fluidised by injection (usually from below) of an inert gas such as argon. The inert gas will be heated prior to introduction into the bed of seed particles in order to bring the bed temperature up to the desired operating temperature. As noted above, the temperature of inert gas leaving the reactor may be taken as being representative of the bed temperature. A number of parameters either manipulated in isolation or in combination can be used to control the bed temperature including the temperature of the inert gas streams being injected into the bed, heat flow across the reactor wall, reactant feed rate, reactant supply temperature (and hence phase), with the preferred strategy dependant on application specific factors like reactor configuration and scale. The rate at which the inert gas is injected into the bed can be varied to manipulate the way in which the seed particles are agitated, and the extent of agitation. With suitable selection of seed particles, and possibly particle size, sintering of particles within the bed does not become an issue. In this case the rate at which inert gas is fed into the bed of seed particles may be relatively low since it is not necessary to apply vigorous agitation in order to minimise sintering or drive the evaporation of the $MgCl_2$ phase by manipulation of partial pressures in the reactor as practised in high temperature dry processes.

When the seed particles have been brought up to temperature the reactants may be introduced into the bed. The titanium tetrachloride is usually supplied into the reactor in vapour form by pre-heating titanium tetrachloride from a storage reservoir. The magnesium may be supplied into the reactor as a solid, molten liquid or gas depending upon the supply technique. Normally, magnesium is supplied into the reactor as a solid or molten liquid. It may be difficult or impractical to pump molten magnesium through piping into the reactor and particulate magnesium may be more practically convenient since in this form it may be free flowing. It may therefore be preferred to use particulate magnesium as the magnesium supply to the reactor. As a guide, generally the particle size of the magnesium will be from 40 to 500 μm.

Having said this, any unreacted molten magnesium may be collected from the reactor and returned (recycled) to the reactor for reaction with titanium tetrachloride. This may make economic and process sense. In practice unreacted magnesium may be carried out of the reactor as a fine fume. In this case it may be collected in an exhaust system associated with the reactor. Alternatively, or additionally, unreacted magnesium may be recovered from the bottom of the reactor as spheres of coalesced magnesium. These coalesced spheres can be separated from other particulate species that may be present and recycled to the reactor. It is envisaged that the latter approach will be preferred since recovery of magnesium fume can be problematic. In practice the process of the invention is likely to be operated with a slight excess of magnesium. Recycling of unreacted magnesium may therefore be an important aspect of the process.

When delivered into the reactor, whether fresh or recycled, molten magnesium may be dispersed by an in situ atomiser or similar dispersion device. The aim is to provide molten magnesium in finely divided form. Irrespective of the form in which the magnesium is supplied to the reactor, at the temperature in the reactor the magnesium will be present in molten form.

The reactants are delivered into the reactor in such a way that they will come into contact and react within the fluidised bed. In one embodiment the titanium tetrachloride is injected into the fluidised bed with the inert gas used to fluidise the bed. This will be done from below the bed through one or more suitably adapted conduits. The magnesium may be delivered through one or more inlets provided in a side wall of the reactor. In one embodiment the reactor is cylindrical and the magnesium is delivered through one or more inlets that are tangential to the side wall of the reactor. It is equally possible for the titanium tetrachloride vapour to be delivered into the reactor through one or more such inlets provided at the side wall of the reactor.

Within the fluidised bed the reactants come together and interact with solid titanium and solid magnesium chloride being formed at the surface of the seed particles. The reaction is an exothermic one and localised heating at the point of reaction will therefore take place. Without wishing to be bound by theory it is believed that this reaction takes place within the outer layer of participating particles and that the localised heating may play an important part in formation of composite particles comprising titanium and magnesium chloride. Thus, when the reaction between magnesium and titanium tetrachloride takes place titanium and magnesium chloride will be formed at the surface of the seed particles. Depending upon the temperature of the fluidised bed the heat of reaction may cause the temperature at the localised site of reaction to increase and exceed the melting point of magnesium chloride, thereby promoting correspondingly localised melting of magnesium chloride. In turn it is believed that the reactants will dissolve in or be absorbed by the molten magnesium chloride and react therein. Agitation of the fluidised bed will cause the particles that have been the site of reaction to be circulated to relatively cooler parts of the fluidised bed resulting in solidification of the magnesium chloride. This process is repeated as particles circulate in the bed.

The composite particles usually comprise regions of titanium embedded in a matrix of magnesium chloride. This is consistent with the mechanism proposed above involving localised melting of magnesium chloride and dissolution/absorption of the reactants. Typically, the composite comprises titanium and magnesium chloride at a mass ratio of about 1:4.

In view of the reaction mechanism that is believed to operate it may be preferable to use magnesium chloride as the seed particles making up the fluidised bed. If titanium particles are used, magnesium chloride must first be deposited on the surface thereof before being available to participate as a vehicle for the magnesium/titanium tetrachloride reaction. Having said this, the use of magnesium chloride brings with it potential handling problems due to its hygroscopic nature.

Advantageously, the particles formed as a result of the reaction between the magnesium and titanium tetrachloride tend to be essentially spherical. As such they are free flowing and this is beneficial in terms of handleability.

It is preferred that the temperature of the fluidised bed is such that the exotherm resulting from the reduction reaction will have the effect of increasing the temperature (albeit in a very localised region) to a temperature equal to or above the melting point of magnesium chloride. In practice for a given reactor set-up (including rate of supply and stoichiometry of reactants, reactor design, seed particles and/or inert gas feed) it may be possible to determine the optimum bed temperature in this regard by sampling and analysis of the particles that are produced as a result of the reaction. If the particles exhibit the composite characteristics described it can be assumed that the bed temperature is set appropriately. If the composite structure is not observed the reactor set-up may be manipulated as required to achieve the desired morphology with respect to the titanium and magnesium chloride formed as a result of the reaction. As noted it is very straightforward to manipulate the bed temperature by varying the temperature of the inert gas used to fluidise the bed.

It is also important that the characteristics of the bed (including temperature and degree of agitation) and/or the rate of supply of reactants is/are such that temperature "runaway" is avoided. This is because if, as a result of the reaction, the bulk temperature of the bed increases above the melting point of magnesium chloride, sintering will start to occur. The bed temperature should be monitored and varied accordingly. This said, in a preferred aspect of the invention the process may be run continuously and under steady state conditions without the need to actively regulate the bed temperature. In this embodiment the heat of reaction is effectively absorbed (at least due to the latent heat of fusion associated with localised melting of magnesium chloride) and distributed over the bulk of the bed. In this case the ability of the bed to act as a heat sink for thermal energy released by the magnesium/titanium tetrachloride reaction is balanced against the thermal energy that is actually released by on-going reactions within the bed based on supply of the reactants. Typically, the process of the invention is operated at or near stoichiometric ratio of the reactants based on the equation reflecting the reduction reaction. Here it may also be advantageous to feed magnesium into the bed as a solid (powder) since some thermal energy will be consumed in melting of the magnesium. In this way introduction of solid magnesium may also act as a heat sink for thermal energy generated by the reduction reaction.

It is intended that the process of the invention will be operated continuously with supply of reactants and removal of suitably sized particles. Advantageously, it has been found that it may be possible to operate the process of the invention continuously without the need to supply fresh seed particles. This is because the process may be self-seeding due to the formation of titanium and magnesium chloride as solids within the fluidised bed. In practice such collisions between particles within the bed may cause fragmentation with the resultant fragments acting as seed particles for subsequent reactions. Here it should be noted that particles are removed from the bed based on their effective aerodynamic diameter (size, density, shape) classification so that small, newly formed seed particles will be retained in the fluidised bed until they have been coarsened appropriately due to reaction between magnesium and titanium tetrachloride at the surface of the particles.

Particles may be removed from the bed when they have reached a suitable size. Here the coarsened particles may be removed from the reactor through a self-regulating process based on the effective aerodynamic diameter of the particles and on fluidisation conditions within the bed. In one embodiment of the invention the rate of supply of inert gas into the bed may be manipulated in order to achieve removal of suitably sized particles. In this embodiment as the rate of gas flow into the bed is reduced the ability of the gas flow to prevent particles entering the gas supply conduit will diminish until such time as particles will fall under gravity down the conduit. Varying the gas flow in this way allows the particles to be separated based on weight, heavier particles being preferentially removed over lighter ones. In this embodiment the gas supply through the conduit is used primarily for the purposes of particle separation rather than for fluidisation of the bed. Thus the reactor will therefore also be equipped with at least one further inert gas supply conduit for the purposes of fluidising the bed of particles. In one embodiment the inert gas is delivered into the bed through concentric nozzles, a central conduit of this arrangement being used for the purposes of particle separation.

After suitably sized particles, typically having a diameter of at least 500 μm have been removed from the bed they are processed to recover the titanium. During transfer of the particles from the fluidised bed and this subsequent processing it is important that the particles are maintained under an inert atmosphere to prevent oxidation of titanium. The titanium present in the composite particles may be less prone to oxidation due to the magnesium chloride matrix that is present but conditions to prevent oxidation should nevertheless be employed. As noted, the composite particles formed during the process tend to be spherical and this can be an advantage in terms of particle flow during the subsequent processing stage.

Recovery of titanium may be achieved by conventional methods such as vacuum distillation or solvent leaching (using a solvent for the magnesium chloride). The solvent may be a liquid or gas. If the magnesium chloride is to be processed in order to regenerate magnesium (by electrolysis), the magnesium chloride removed from the titanium should remain anhydrous. In this case vacuum distillation (with subsequent condensation of magnesium chloride) or the use of a non-aqueous solvent should be employed. The composite particles produced by the method of the invention have been found to be very amenable to conventional separation methodology. The titanium produced has also been found to be of high purity and in a form that is immediately useful for subsequent processing and use.

As a two stage process in which each stage has a single intended outcome, it is possible to design and operate each stage for optimum results. This may not be possible with a single stage process. Operating a two stage process may also mean that plant layout and construction is simplified. The fact that the process of the invention is operated at relatively low temperature also provides more freedom with respect to materials of construction. This will also likely lead to cost benefits.

The process of the invention may be carried out in any suitably constructed plant. One skilled in the art would be familiar with the kind of layout required given the individual process stages described. One skilled in the art would also be familiar with suitable materials for plant construction based on the intended operating temperatures etc. described herein.

The invention will now be illustrated with reference to the following non-limiting examples.

EXAMPLE 1

A cylindrical reaction vessel made from stainless steel with a conical base having an internal diameter of 200 mm and an aspect ratio of 4 was purged with high purity argon then heated externally to 680° C. Once the pre-heated gas temperature measured at a control point 50 mm above the upper surface normally associated with a bed reached 655° C., the system was charged with 60 grams of 500-1000 μm titanium sponge particles. Once the control point temperature had recovered to 655° C., the two reactant feeds were applied.

Titanium tetrachloride was supplied at a rate of 160 milliliters per hour as a vapour at a temperature of around 500° C. In this example, the reductant phase was magnesium metal, which was supplied at a rate of 71 grams per hour as a finely divided powder (44-500 μm) conveyed in a low volume argon gas carrier stream entering the reactor at a temperature of around 500° C. Both reactant inlets were located at the base of the fluidising zone.

Upon addition to the fluidised bed, the temperature of the gas leaving the bed increased by around 22° C. consistent with the exothermic nature of the reaction. The reactor was easy to operate with the bed remaining fluidised despite its proximity to the melting point of $MgCl_2$ indicating sinter free operation is possible. The test produced free flowing small black spheres (0.1 to 1 mm diameter) which "softened" upon contact with moisture in the air, confirming that they contained anhydrous magnesium chloride (highly hygroscopic).

The rate of the reactants supplied to the reactor was intentionally increased by a factor of more than two over the duration of the experiment and no unreacted $TiCl_4$ was detected in the exhaust scrubber. This was another unanticipated outcome as the expectation based on conventional thinking was that the conversion of $TiCl_4$ to Ti would be poor at low temperatures.

In the context of a constant gas flow rate, the higher rates would have also been expected to push the bed temperature well above the melting point of magnesium chloride (712° C.). In practice the control temperature, which represents the bulk bed temperature, remained below 700° C. This surprising result was later attributed to a mechanism by which the extra energy released from the reaction is absorbed by the bed in the conversion of some of the $MgCl_2$ on the surface of the particles from a solid to a liquid (latent heat of fusion). The process is therefore self limiting within generous limits with respect to bed temperature hence the ability to keep the bed in the apparently narrow band required (650-712° C.) is significantly enhanced. The conversion of some of the surface $MgCl_2$ to liquid is also thought to be the mechanism by which the bed self-seeds itself; drops of liquid $MgCl_2$ are mechanically knocked off the particles by the action to provide new sites for reaction/deposition.

Heating of the composite particles from this run under an inert gas atmosphere produced porous titanium metal structures that assumed the shape and size of their composite particle precursors. The heating step volatilised the $MgCl_2$ leaving behind the titanium particles as originally envisaged.

EXAMPLE 2

The outcomes from Example 1 were verified and quantified in the same reactor system with the exception that the process was seeded with anhydrous magnesium chloride particles. Fifty grams of analytical grade magnesium chloride powder with a particle size-325 mesh was transferred under argon to the reactor, which had been previously purged with argon and preheated to 680° C. To achieve vigorous fluidisation, the high purity argon was passed as a rate of 50.5 standard liters per minute. Once the control point temperature, measured 50 mm above the upper bed surface, recovered to 655° C. the two reactant feeds were applied. Titanium tetrachloride was supplied at a rate of 518 grams per hour as a vapour at a temperature of around 500° C. In this example, the reductant phase was magnesium metal, which was supplied at a rate of 60 grams per hour as a finely divided powder (44-500 μm) via a low volume argon gas carrier.

The temperature increase observed during this test was around 10° C., which was again less than could be accounted for with sensible heat changes alone and sufficient to keep the control point temperature within between the melting point of the magnesium metal but below that of magnesium chloride. The test continued for around 132 minutes and yielded 647 grams of solid product in the form of spheres in the range of 45-850 μm. Despite the relatively low temperature and almost stoichiometric reagent rate, no unreacted $TiCl_4$ was trapped in the exhaust gas scrubber. The high conversion was confirmed by closure of the material balance to within 0.5% of expectation.

Environmental scanning electron microscopy (ESEM) analysis confirmed that the product from the reaction stage consists of discrete titanium particles in a continuous magnesium chloride phase (FIGS. 1*a* and 1*b*). The composition of the product was 79.8 mass % $MgCl_2$ and 20.1 mass % titanium which is close to that expected from the reaction stoichiometry. To recover the titanium metal the product was subsequently heated under an argon atmosphere to 1200° C. to selectively remove the $MgCl_2$ phase. Although the individual titanium particles are fine, this approach causes them to be carried to the outer evaporation front by the mobile $MgCl_2$ phase where they can contact other titanium particles and consolidate via a sintering mechanism. The resulting deposit takes the form of hollow spheres with a near continuous shell of titanium metal with approximately the same diameter as the starting $MgCl_2$/Ti composite particle. An ESEM image of such a particle is given in FIG. 2.

The mass remaining after heat treatment was 20.0% of the original, which is close to expectations for a titanium only residue. Wet chemical analysis subsequently confirmed that the shell was almost pure titanium.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge in Australia.

The claims defining the invention are as follows:

1. A method for producing titanium by reaction of titanium tetrachloride with magnesium in a reactor comprising a fluidized bed, wherein the temperature in the reactor is above the melting point of magnesium and below the melting point of magnesium chloride, wherein the reaction results in formation of particles comprising titanium and a solid magnesium chloride by-product, and wherein the particles are removed from the reactor and processed in order to recover the titanium.

2. A method according to claim 1, wherein the temperature in the reactor is from 650° C. to 710° C.

3. A method according to claim 1, wherein the fluidized bed comprises seed particles formed of titanium or of magnesium chloride, or a mixture of titanium seed particles and magnesium chloride seed particles.

4. A method according to claim 1, wherein titanium tetrachloride is supplied into the reactor in vapour form by preheating tetrachloride from a storage reservoir.

5. A method according to claim 1, wherein magnesium is supplied into the reactor as a solid.

6. A method according to claim 5, wherein particulate magnesium is supplied to the reactor.

7. A method according to claim 1, wherein magnesium is supplied to the reactor as a molten liquid.

8. A method according to claim 1, wherein unreacted molten magnesium is drained from the reactor and returned to the reactor for reaction with titanium tetrachloride.

9. A method according to claim 1, wherein at least initially the fluidised bed is made up of magnesium chloride seed particles.

10. A method according to claim 1, the process being self-seeding such that it operates continuously without the need to supply fresh seed particles to the fluidized bed.

11. A method according to claim 1, wherein particles comprising titanium are removed from the bed when they have reached a suitable size through a self-regulating process based on the effective aerodynamic diameter of the particles and on fluidization conditions within the bed.

12. A method according to claim 1, wherein particles comprising titanium and having a diameter of at least 500 μm are removed from the reactor and processed to recover titanium.

* * * * *